United States Patent [19]

Sheppard, Jr.

[11] 3,972,169

[45] Aug. 3, 1976

[54] SADDLE HANGER

[76] Inventor: Isaac Sheppard, Jr., 1030 W. Elmwood St., Clawson, Mich. 48017

[22] Filed: Jan. 12, 1976

[21] Appl. No.: 648,008 .

[52] U.S. Cl. ..... 52/702; 52/715; 52/751; 52/752; D8/235; 248/300; 403/232

[51] Int. Cl.[2] ..... E04C 3/02

[58] Field of Search ..... 52/702, 712, 713, 714, 52/715, 751, 752, 753 C, 753 R, 758 D; D8/234, 235, 236; 248/300, 301; 403/232, 247

[56] References Cited

UNITED STATES PATENTS

| | | | |
|---|---|---|---|
| 478,163 | 7/1892 | Lehman | 52/751 |
| 546,147 | 9/1895 | Gregg | 52/751 |
| 828,488 | 8/1906 | Lanz | 52/702 |
| 858,838 | 7/1907 | Tuteur | 52/702 |
| 1,723,605 | 8/1929 | Darling | 403/232 |
| 1,833,692 | 11/1931 | Silvio | 403/232 |

*Primary Examiner*—Ernest R. Purser
*Assistant Examiner*—William Randolph
*Attorney, Agent, or Firm*—Leydig, Voit, Osann, Mayer & Holt, Ltd.

[57] ABSTRACT

A saddle hanger formed from a trapezoidal blank alternately cut from flat sheet metal stock with two cut lines separating the front panel from the side and top saddle portions and adapted to be creased along at least four fold lines at the junctures of: the front panel and stirrup seat; the stirrup seat and stirrup sides; the stirrup sides and side saddle portions; and, the side saddle and top saddle portions so that when the blank is bent along the fold lines the stirrup seat and sides project perpendicular to the front panel and to each other and the side saddle portions overlie and reinforce portions of the front panel. Additionally, the top of the front panel may be bent back beneath the top saddle portions and the latter may terminate in folded down tabs. The side and top saddle portions may include pre-punched holes which register with similar holes in the front and top panel portions.

10 Claims, 4 Drawing Figures

SADDLE HANGER

SUMMARY OF THE INVENTION

The present invention relates generally to building components and more particularly concerns sheet metal saddle hangers for supporting the ends of building components such as floor and roof trusses from beams and girders.

Over the years a number of different forms of metal hangers for supporting wood building components have been employed. Some of the early forms were, quite simply, strap iron bent into a U-shape and provided with holes to receive suitable fasteners such as nails. More recently, sheet metal stampings have been employed to form U-shaped stirrups. In some of these, the legs of the stirrup are twisted 90° out of the plane of the stirrup sides so that the upper portion of the legs will lie flush on the face of a beam or the like. In another form the stirrup legs are bent into an angle-iron configuration with both a flat and a projecting web portion over substantially their entire length.

In either of the foregoing forms, the strength of the hanger depends directly on the thickness of the sheet metal used. Thus, strong hangers have required thick, heavy gauge sheet stock that results in a relatively heavy hanger, difficult to form in the first place and even more difficult to hide with other construction materials where cosmetic appearances are important. On the other hand, hangers made of thin gauge sheet stock have only limited load supporting capacity.

Accordingly, it is the primary aim of the present invention to provide a one-piece saddle hanger of relatively thin gauge sheet metal that includes portions folded over to provide double thickness and increased strength.

Another object is to provide for such a saddle hanger having pre-punched holes in the doubled over portions to permit the use of larger, heavier fasteners such as nails.

A more specific object is to form a saddle hanger from a substantially trapezoidal blank which permits alternate stamping of the blanks from sheet stock with very little waste. It is also a related object to form a saddle hanger by bending the blank along crease lines which divide the blank into a plurality of abutting triangular segments which afford relatively great strength for their weight.

Other objects and advantages of the invention will become apparent upon reading the following detailed description and upon reference to the drawings, in which:

DETAILED DESCRIPTION OF THE INVENTION

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Figure 1:
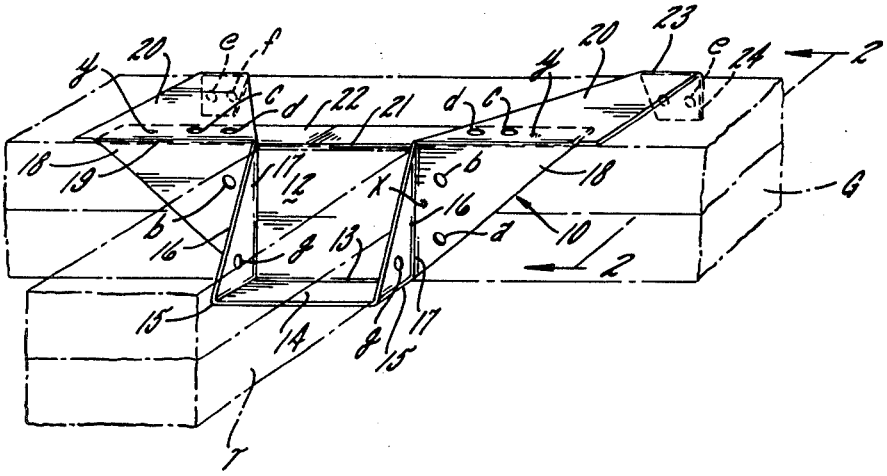
FIG. 1 is a perspective view of the saddle hanger of the present invention.

Turning now to the drawings, there is shown in FIG. 1 a saddle hanger 10 which embodies the present invention. Such a saddle hanger is particularly well suited for supporting the end of a building component such as a floor or roof truss T (shown in phantom) from a beam, sill or girder G (also shown in phantom).

Figure 3:
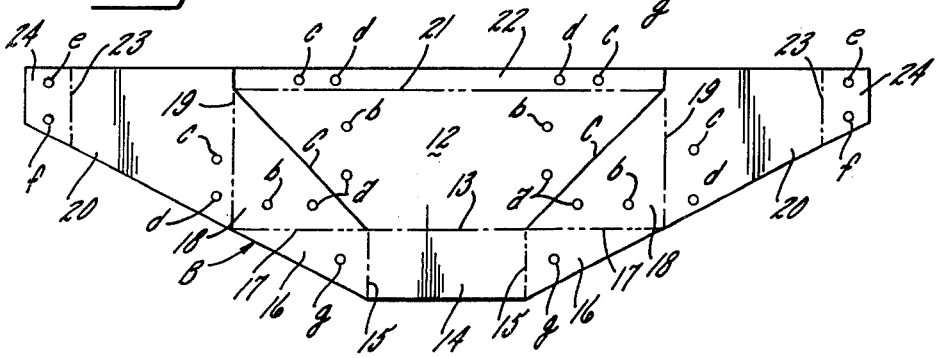
FIG. 3 is a plan view of the blank from which the saddle hanger is formed; and, FIG. 4 is a plan view of a strip of sheet stock from which blanks are alternately struck.
Figure 4:
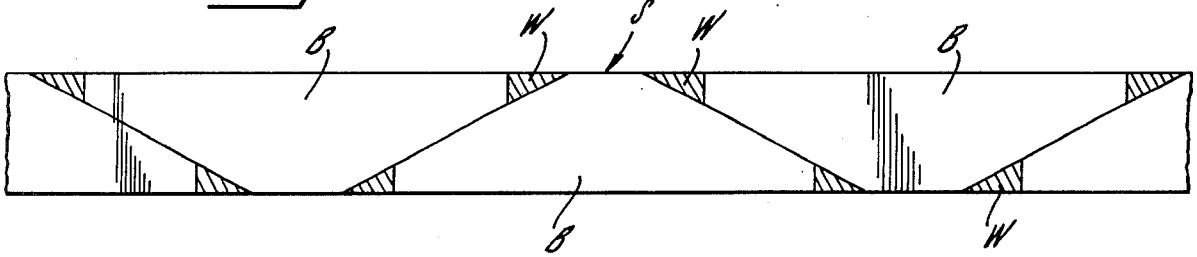

Referring to FIGS. 3 and 4, the saddle hanger 10 of the present invention is formed from a substantially trapezoidal blank B alternately struck from sheet metal stock S so as to leave only a small amount of waste W. Preferably, at the time the blank B is struck from the sheet S, the blank is also cut along two lines C which define the side edges of a truncated, substantially triangular front panel 12 of the hanger.

To support the truss T, the hanger 10 includes a stirrup seat 14 which projects perpendicularly from the front panel 12 when bent along a first crease line 13 which truncates the front panel. The stirrup seat 14 is supported and reinforced by a pair of substantially right triangular stirrup sides 16 each joined at its base to one side of the stirrup seat 14 along a second crease line 15. As shown in FIG. 1 the stirrup sides 16 are bent along the second crease lines 15 so as to project at mutually different right angles to both the front panel 12 and the stirrup seat 14.

For reinforcing the front panel 12 and supporting the stirrup sides 16, a pair of substantially right triangular side saddle portions 18 are joined leg to leg to the stirrup sides 16 along a third crease line 17. As shown in FIG. 1, the side saddle portions 18 are bent along the crease lines 17 to project at right angles to the stirrup sides 16 and to overlie the side portions of the front panel 12 in substantially coplanar relation. The overlapped, reinforced construction is more particularly illustrated in FIG. 2.

Figure 2:
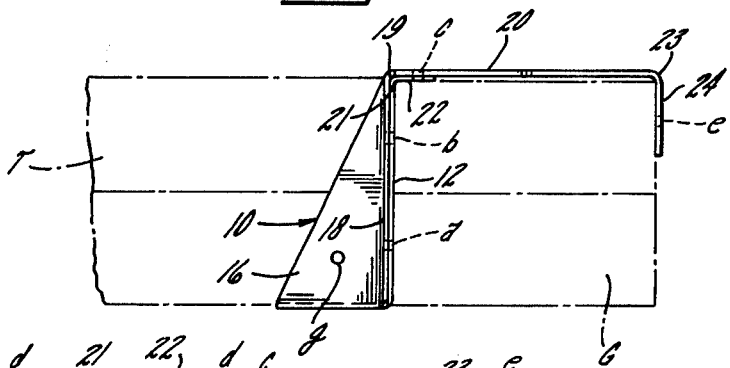
FIG. 2 is a side elevation as seen from line 2—2 in FIG. 1.

In order to hang the hanger 10 over the top of the girder G it is provided with a pair of substantially right triangular top saddle portions 20 each joined at its base to the base of one of the side saddle portions along a fourth crease line 19. As shown in FIGS. 1 and 2, the top saddle portions 20 project perpendicularly to the front panel 12 and in the opposite direction therefrom relative to the stirrup seat 14 so as to overlie the top of the girder G.

To provide for further support and reinforcing to the front panel 12, stirrup sides 16 and seat 14, the hanger 10 is preferably formed with a substantially rectangular top portion 22 joined at one edge to the base of the triangular front panel along a fifth crease line 21. As shown in FIGS. 1 and 2, the top portion 22 projects perpendicularly to the front panel 12 with its ends beneath and in substantially coplanar relation to the top saddle portions 20, so as to overlie the top front portion of the girder G.

As an additional anchoring feature, the saddle hanger 10 of the present invention is preferably provided with a pair of end tabs 24 each joined at one edge to one of the top saddle portions along a sixth crease line 23. Referring to FIGS. 1 and 2 it will be seen that the end tabs 24 project perpendicularly downwardly from the top saddle portions 20 so as to engage the back side of the girder G.

In keeping with another aspect of the present invention, the blank B may be formed with pre-punched holes *a*, *b* in the front panel 12 and side saddle portions 16 adapted to register with one another when the side saddle portions are bent along the second and third crease lines 15, 17. Likewise, the blank B may be formed with pre-punched holes *c*, *d* in the top portion 22 and top saddle portion 20 adapted to register with one another when the top is bent along the fifth crease line 21 and the top saddle portions are bent along the fourth crease line 19.

To further anchor the saddle hanger 10 to the girder G and the truss end T, the end tabs 24 and the side saddle portions 16 may also be provided with pre-punched holes *e*, *f* and *g*. It will be understood, of course, to those skilled in the art that the pre-punched holes *a-g* greatly facilitate the insertion of suitable fasteners such as nails or screws through the hanger 10 and into the girder G and truss T.

Pursuant to another feature of the invention the blank B may be pre-creased along crease lines 13, 15, 17, 19, 21 and 23 and shipped flat. The blank may then be quickly and conveniently bent along the respective crease lines at the job site to form the saddle hanger 10 of the present invention. Alternatively, the blank B can be creased and bent substantially along lines 13, 15, 17 and 19, for example, and shipped in nested relation to the job site where, after installation, the end tabs 24 may be bent down along crease lines 23. It should also be understood that when the hanger 10 is pre-formed, prior to shipment, it may be desirable to further reinforce the hanger by spot-welding the overlapping side saddle 18 and front panel 12 portions together as well as the top saddle 20 and top portion 22 together as shown, for example, in FIG. 1 by spot welds *x* and *y*.

In a preferred embodiment, the saddle hanger 10 of the present invention is formed from a blank B struck from a 5 inch width strip of 18 ga. sheet metal. By alternately cutting the blanks B from the strip S four 18 ½ inch blanks can be obtained from 54 running inches of strip stock. Only a small 2 ½ inch triangular portion is trimmed as waste W.

To accommodate standard size wooden construction components, the stirrup seat may be made 3 ½ inches wide to accept two 2 × 4s or one 4 × 4. Likewise the top saddle portions 20 may have a length of 3 ½ inches between crease lines 19 and 23 for the same reason. If the truss end T and girder G are each formed of two 2 × 4s, as shown in FIG. 1, the front panel 12 is preferably formed with a height of 3 inches between crease lines 13 and 21. It will be understood, of course, that the foregoing dimensions are illustrative and that saddle hangers having other dimensions to accommodate other sizes of structural members can be made without departing from the present invention.

It should also be understood that the terms substantially triangular, rectangular and trapezoidal as used herein are intended to be generally descriptive of the various portions of the saddle hanger 10 disclosed and claimed herein and it is not intended to limit the shapes of such portions to those precise geometrical forms except insofar as necessary to define the cooperating interrelationships of such portions as they combine to form the integral one-piece saddle hanger of the present invention.

I claim as my invention:

1. A one-piece sheet metal saddle hanger for supporting an end of a building component or the like, comprising: substantially triangular front panel with a stirrup seat joined thereto along a first crease line which truncates said front panel, said stirrup seat adapted to project perpendicularly from said front panel when bent along said first crease line, a pair of substantially right triangular stirrup sides each joined at its base to one side of said stirrup seat along a second crease line and each adapted to project at mutually different right angles from both said front panel and said stirrup seat when bent along said second crease line, a pair of substantially right triangular side saddle portions each joined along one leg to the leg of one of said stirrup sides along a third crease line and adapted to project at a right angle to said stirrup side and to overlie a portion of said front panel in substantially coplanar relation when bent along said third crease line, and a pair of truncated, substantially right triangular top saddle portions each joined at its base to the base of one of said side saddle portions along a fourth crease line and adapted to project perpendicularly to said front panel and in the opposite direction therefrom relative to said stirrup seat when bent along said fourth crease line.

2. A saddle hanger as defined in claim 1 including a pair of end tabs each joined at one edge to one of said top saddle portions along a sixth crease line which truncates said top saddle portion and adapted to project perpendicularly therefrom when bent along said sixth crease line.

3. A saddle hanger as defined in claim 1 including holes pre-punched in said front panel and said side saddle portions with said latter holes adapted to register with said former holes when said side saddle portions are bent along said second and third crease lines.

4. A saddle hanger as defined in claim 1 formed from a substantially trapezoidal blank.

5. A plurality of saddle hangers as defined in claim 4 wherein the respective trapezoidal blanks are cut in alternating right-side-up and upside down relation from substantially flat sheet stock.

6. A saddle hanger as defined in claim 1 including a substantially rectangular top portion joined at one edge to the base of said triangular front panel along a fifth crease line and adapted to project perpendicularly to said front panel and with the ends thereof beneath and in substantially coplanar relation to said top saddle portions when bent along said fifth crease line.

7. A saddle hanger as defined in claim 6 including holes pre-punched in said top portion and said top saddle portions with said latter hole adapted to register with said former holes when said top is bent along said fifth crease line and said top saddle portions are bent along said fourth crease lines.

8. A saddle hanger as defined in claim 7 including holes pre-punched in said front panel and said side saddle portions with said latter holes adapted to register with said former holes when said side saddle portions are bent along said second and third crease lines.

9. A saddle hanger as defined in claim 6 including a pair of end tabs each joined at one edge to one of said top saddle portions along a sixth crease line which truncates said top saddle portion and adapted to project perpendicularly therefrom when bent along said sixth crease line.

10. A saddle hanger as defined in claim 9 formed from a substantially trapezoidal blank.

* * * * *